US008564206B2

(12) United States Patent
Hamamoto et al.

(10) Patent No.: US 8,564,206 B2
(45) Date of Patent: Oct. 22, 2013

(54) LED LIGHTING DEVICE AND ILLUMINATION APPARATUS INCLUDING SAME

(75) Inventors: Katunobu Hamamoto, Neyagawa (JP); Masafumi Yamamoto, Kyoto (JP); Keisuke Ueda, Hirakata (JP); Hisaya Takikita, Habikino (JP)

(73) Assignee: Panasonic Corporation, Osaka (JP)

( * ) Notice: Subject to any disclaimer, the term of this patent is extended or adjusted under 35 U.S.C. 154(b) by 167 days.

(21) Appl. No.: 13/326,379

(22) Filed: Dec. 15, 2011

(65) Prior Publication Data

US 2012/0153832 A1 Jun. 21, 2012

(30) Foreign Application Priority Data

Dec. 20, 2010 (JP) ..... 2010-283643

(51) Int. Cl.
*H05B 37/02* (2006.01)

(52) U.S. Cl.
USPC ..... 315/121; 315/297; 315/307; 315/224

(58) Field of Classification Search
USPC ..... 315/121, 125, 126, 127, 193, 185 R, 315/219, 224, 240, 250, 307, 297
See application file for complete search history.

(56) References Cited

U.S. PATENT DOCUMENTS

| | | | | |
|---|---|---|---|---|
| 5,783,933 | A * | 7/1998 | Bailly | 323/282 |
| 2004/0113567 | A1* | 6/2004 | Yamauchi et al. | 315/291 |
| 2005/0248289 | A1* | 11/2005 | Van Casteren et al. | 315/224 |
| 2010/0039039 | A1* | 2/2010 | Goriki et al. | 315/246 |
| 2010/0109572 | A1* | 5/2010 | Kamoi et al. | 315/307 |
| 2010/0117547 | A1* | 5/2010 | Goriki et al. | 315/224 |

FOREIGN PATENT DOCUMENTS

JP 2002-354783 12/2002

* cited by examiner

*Primary Examiner* — Daniel D Chang
(74) *Attorney, Agent, or Firm* — Bacon & Thomas, PLLC

(57) ABSTRACT

An LED lighting device includes a step-up chopper which includes a first switching element and increases an output voltage applied from a DC power supply, a step-down chopper which includes a second switching element and decreases the output voltage from the step-up chopper to apply the decreased output voltage to a light source unit having light emitting diodes, a controller which controls operations of the first and the second switching element, a current limiter which includes a current limiting element and a switch; and a voltage detection unit. The controller stops an operation of the first switching element when the voltage detection unit detects the voltage applied to the light source unit exceeding a predetermined voltage value, and the switch allows a current to flow through the path passing through the current limiting element when the operation of the first switching element is stopped.

8 Claims, 3 Drawing Sheets

LED LIGHTING DEVICE AND ILLUMINATION APPARATUS INCLUDING SAME

FIELD OF THE INVENTION

The present invention relates to an LED lighting device and an illumination apparatus including same.

BACKGROUND OF THE INVENTION

Conventionally, there is known a power supply apparatus which supplies electric power to a load (see, e.g., Japanese Patent Application Publication No. 2002-354783). In the power supply apparatus disclosed in Japanese Patent Application Publication No. 2002-354783, an AC voltage of a commercial AC power source is full-wave rectified by a rectifier having a diode bridge, and a ripple voltage outputted from the rectifier is converted by a step-up/step-down chopper circuit having two transistors. Further, a DC voltage outputted from the step-up/step-down chopper circuit is converted into a high frequency power by an inverter circuit, and the high frequency power outputted from the inverter circuit is supplied to a load circuit.

The step-up/step-down chopper circuit includes a step-down chopper on a front side and a step-up chopper on a rear side. A common inductor is used in both of the step-down chopper and the step-up chopper. A switching element of the step-down chopper is switched on and off by a PWM control circuit through a driver in synchronism with a switching element of the step-up chopper. In the step-up/step-down chopper circuit, the inductor is used for both step-up and step-down. Accordingly, an input voltage can be not only increased but also decreased.

However, in the power supply apparatus described above, when the switching element of the step-down chopper is short-circuited, the voltage outputted from the rectifier is applied to the load circuit without being decreased, resulting in an excessive current (over-current) flowing through the load circuit. For example, in a case where the power supply apparatus is used as an LED lighting device having a light source unit having light emitting diodes as a load, if an over-current flows through the light source unit, the lifetime of the light source unit may be shortened and the light source unit can be broken.

SUMMARY OF THE INVENTION

In view of the above, the present invention provides an LED lighting device capable of preventing an over-current from flowing through a light source unit when a switching element of a step-down transformer is short-circuited, and an illumination apparatus using the same.

In accordance with an embodiment of the present invention, there is provided an LED lighting device including: a step-up chopper which includes at least a first inductor and a first switching element, the step-up chopper serving to increase an output voltage applied from an external DC power supply and output the increased output voltage; a step-down chopper which includes at least a second inductor and a second switching element, the step-down chopper serving to decrease the output voltage from the step-up chopper and apply the decreased output voltage to a light source unit having one or more light emitting diodes; a controller which controls operations of the first switching element and the second switching element; a current limiter which includes a current limiting element for limiting current flowing therethrough and a switch for switching between a path passing through the current limiting element and a path not passing through the current limiting element on a front side of the step-up chopper; and a voltage detection unit which detects a load voltage applied to the light source unit.

The controller stops an operation of the first switching element when the voltage detection unit detects the voltage applied to the light source unit exceeding a predetermined voltage value, and the switch allows a current to flow through the path passing through the current limiting element when the operation of the first switching element is stopped.

Further, in the current limiter, a current may flow through the path passing through the current limiting element at the time when the DC power supply is turned on, and the switch may allow the current to flow through the path not passing through the current limiting element when an operation of the step-up chopper is started.

Further, the step-down chopper may further include a third switching element connected in series to the second switching element, and the controller convert a state of the third switching element into an ON state when the voltage detected by the voltage detection unit exceeds the predetermined voltage value.

In accordance with another embodiment of the present invention, there is provided an illumination apparatus including: the LED lighting device described above, and an apparatus main body having the LED lighting device and the light source unit.

In accordance with the present invention, it is possible to prevent an over-current from flowing through a light source unit when a switching element of a step-down chopper is short-circuited.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to accompanying drawing which form a part hereof.

(First Embodiment)

Here, an LED lighting device in accordance with, a first embodiment of the present invention will be described with reference to accompanying drawing.

Figure 1:
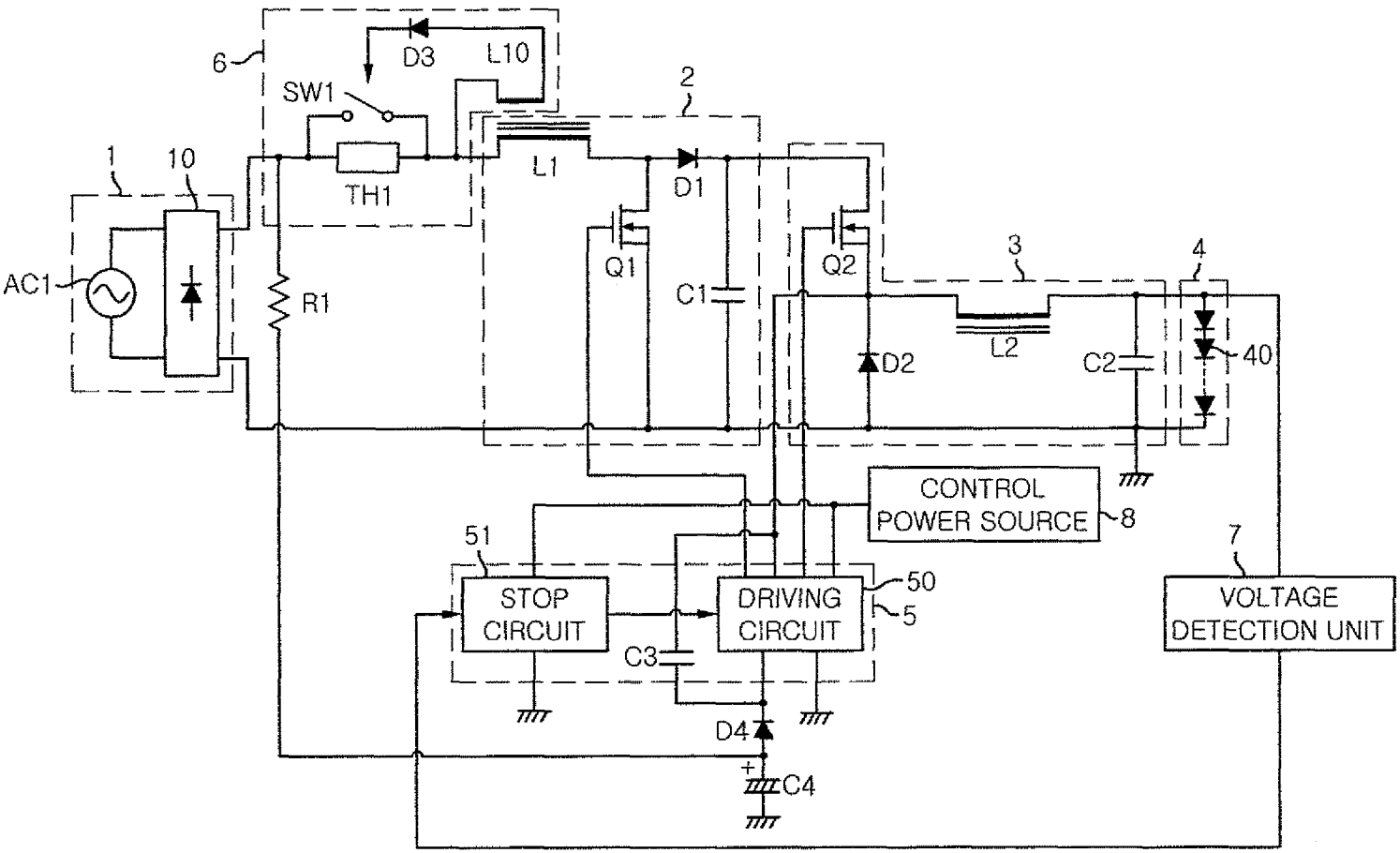
FIG. 1 schematically shows a circuit diagram of a first embodiment of an LED lighting device in accordance with the present invention.

The LED lighting device of the present embodiment includes, as shown in FIG. 1, a step-up chopper 2, a step-down chopper 3, a controller 5, a current limiter 6 and a voltage detection unit 7. An output voltage is inputted to the step-up chopper 2 from an external DC power supply unit 1. The DC power supply unit 1 includes an AC power supply AC1 and a diode bridge 10 for full-wave rectifying an AC voltage inputted from the AC power supply AC1 to output a ripple voltage.

The step-up chopper 2 includes a series circuit of a first inductor L1 and a first switching element Q1, and series circuit of a diode D1 and a capacitor C1 being connected in parallel to the first switching element Q1. The step-up chopper 2 is connected between output terminals of the diode bridge 10. The first switching element Q1 has an n-channel MOSFET, and is controlled to be switched on and off by a drive signal applied from a drive circuit 50 of the controller 5 as will be described later. Accordingly, the step-up chopper 2 increases the ripple voltage applied from the DC power supply unit 1 by appropriately controlling on and off of the first switching element Q1 to output a specific DC voltage.

The step-down chopper 3 includes a series circuit of a second switching element Q2 and a diode D2, and a series circuit of a second inductor L2 and a capacitor C2 being connected in parallel to the diode D2. The step-down chopper 3 is connected between output terminals of the step-up chopper 2. Further, the diode D2 has a cathode connected to a low potential side of the second switching element Q2. The second switching element Q2 has an n-channel MOSFET, and is controlled to be switched on and off by a drive signal applied from the drive circuit 50 of the controller 5 as will be described later. Accordingly, the step-down chopper 3 decreases the output voltage from the step-up chopper 2 by appropriately controlling on and off of the second switching element Q2 to apply the decreased DC voltage to a light source unit 4 provided on the rear side of the step-down chopper 3, the light source unit 4 having one or more light emitting diodes 40 connected in series to each other.

The controller 5 includes the drive circuit 50 applying a drive signal to each of the switching elements Q1 and Q2, and a stop circuit 51 applying a stop signal to the driving circuit 50 to stop an operation of each of the switching elements Q1 and Q2 based on a detection voltage detected by the voltage detection unit 7 as will be described later. A driving source voltage is supplied to the driving circuit 50 and the stop circuit 51 from a control power source 8.

In this case, a driving capacitor C3 as a power source for driving the second switching element Q2 is connected to the driving circuit 50 of the controller 5. The driving capacitor C3 has one end connected to a source terminal of the second switching element Q2. Further, the driving capacitor C3 has the other end connected to a series circuit of a diode D4 and a charging capacitor C4. The charging capacitor C4 functions as a charging power source for charging the driving capacitor C3, and one end on a low potential side of the charging capacitor C4 is connected to the ground. Further, one end on a high potential side of the charging capacitor C4 is connected to one end on a high potential side of the diode bridge 10 through a resistor R1. Accordingly, the charging capacitor C4 is charged from time to time by an output of the diode bridge 10. The driving capacitor C3 is charged by a current flowing in a loop including the charging capacitor C4, the diode D4, the driving capacitor C3, the second inductor L2 and a parallel circuit of the capacitor C2 and the light source unit 4 in a period while the current flows through the second inductor L2.

The current limiter 6 is provided on a front side of the step-up chopper 2, and includes a thermistor TH1 serving as a current limiting element, a switch SW1 connected in parallel to the thermistor TH1, and a secondary coil L10 magnetically coupled to the first inductor L1. The thermistor TH1 is a positive thermistor having positive thermal characteristics in which the impedance increases as the temperature increases. The switch SW1 is formed of, e.g., a thyristor, and an induced voltage generated in the secondary coil L10 is applied to the switch SW1 through a diode D3. Further, the switch SW1 is switched on when the induced voltage of the secondary coil L10 is equal to or larger than a predetermined value. The thermistor TH1 is provided between one end on the high potential side of the diode bridge 10 and the first inductor L1. Accordingly, if the switch SW1 is switched off, the current flows through a path passing through the thermistor TH1 and if the switch SW1 is switched on, the current flows through a path not passing through the thermistor TH1.

The voltage detection unit 7 detects a load voltage applied to the light source unit 4, and is configured such that a series circuit of a plurality of resistors is connected in parallel to the light source unit 4. Further, the voltage detection unit 7 inputs a voltage obtained by dividing the load voltage using a plurality of resistors to the stop circuit 51 of the controller 5 as a detection voltage. If the detection voltage value detected by the voltage detection unit 7 exceeds a predetermined threshold value, i.e., the load voltage exceeds a predetermined voltage (becomes an over-voltage), the stop circuit 51 applies a stop signal to the driving circuit 50.

Hereinafter, an operation of the present embodiment will be described with reference to FIG. 1. First, if the AC power supply AC1 is turned on, i.e., the DC power supply unit 1 is turned on, an inrush current temporarily flows.

In order to prevent the inrush current, the current limiter 6 is provided in the present embodiment. When the DC power supply unit 1 is turned on, the switch SW1 is in an OFF state since the induced voltage is not generated in the secondary coil L10. Accordingly, since the inrush current flows through the path passing through the thermistor TH1, the inrush current is limited by the thermistor TH1.

Then, a driving signal is applied to each of the switching elements Q1 and Q2 from the driving circuit 50 of the controller 5, so that the switching elements Q1 and Q2 are driven and the step-up chopper 2 and the step-down chopper 3 are operated. Accordingly, a voltage is applied to the light source unit 4 such that the light source unit 4 is turned on. When the operation of the step-up chopper 2 is started, an induced voltage is generated in the secondary coil L10, so that the OFF state of the switch SW1 is changed to an ON state. Consequently, the current outputted from the DC power supply unit 1 flows through a path not passing through the thermistor TH1. Accordingly, the thermistor TH1 can limit only the inrush current occurring at the time when the DC power supply unit 1 is turned on.

Next, an operation when a load voltage increases due to a degradation of the light emitting diodes 40 of the light source unit 4 to thereby become an over-voltage will be described. If a load voltage becomes an over-voltage, the detection voltage detected by the voltage detection unit 7 exceeds a predetermined threshold value. Consequently, the stop circuit 51 of the controller 5 applies a stop signal to the driving circuit 50 such that the driving circuit 50 stops the operation of each of the switching elements Q1 and Q2. Accordingly, the operations of the step-up chopper 2 and the step-down chopper 3 are stopped, so that the over-voltage is not applied to the light source unit 4 and, therefore, the light source unit 4 is protected.

Here, if the second switching element Q2 of the step-down chopper 3 is broken due to an abnormality occurring therein, then the second switching element Q2 is short-circuited such that the step-down chopper 3 does not work, and an output voltage of the step-up chopper 2 is applied to the light source unit 4. Consequently, the load voltage of the light source unit 4 increases to become an over-voltage, and an over-current exceeding a predetermined current value flows through the light source unit 4. Accordingly, the lifetime of the light source unit 4 may be shortened and the light source unit 4 may be broken occasionally.

In case of the conventional invention, the current limiter 6 in accordance with the present embodiment is not provided. Therefore, even if the controller 5 stops the operation of each of the switching elements Q1 and Q2 when an over-voltage is detected, an over-current continuously flows through the light source unit 4 since the second switching element Q2 is short-circuited.

On the other hand, in the present embodiment, when the operation of the first switching element Q1 is stopped, an induced voltage is not generated any more in the secondary coil L10, so that the induced voltage is reduced and the state of the switch SW1 is changed to an OFF state. When the state of the switch SW1 is changed to the OFF state, the current outputted from the DC power supply unit 1 flows through a path passing through the thermistor TH1. Since the current flows through the thermistor TH1, the temperature of the thermistor TH1 increases and the impedance of the thermistor TH1 increases correspondingly. Accordingly, the current outputted from the DC power supply unit 1 is limited by the thermistor TH1. As a result, it is possible to limit the load current flowing through the light source unit 4 and prevent the over-current from flowing through the light source unit 4.

As described above, since the current limiter 6 is provided in the present embodiment, it is possible to prevent the over-current from flowing through the light source unit 4 when the second switching element Q2 of the step-down chopper 3 is short-circuited. Further, in the present embodiment, by installing the current limiter 6, it is possible to limit the inrush current occurring at the time when the DC power supply unit 1 is turned on.

(Second Embodiment)

Figure 2:
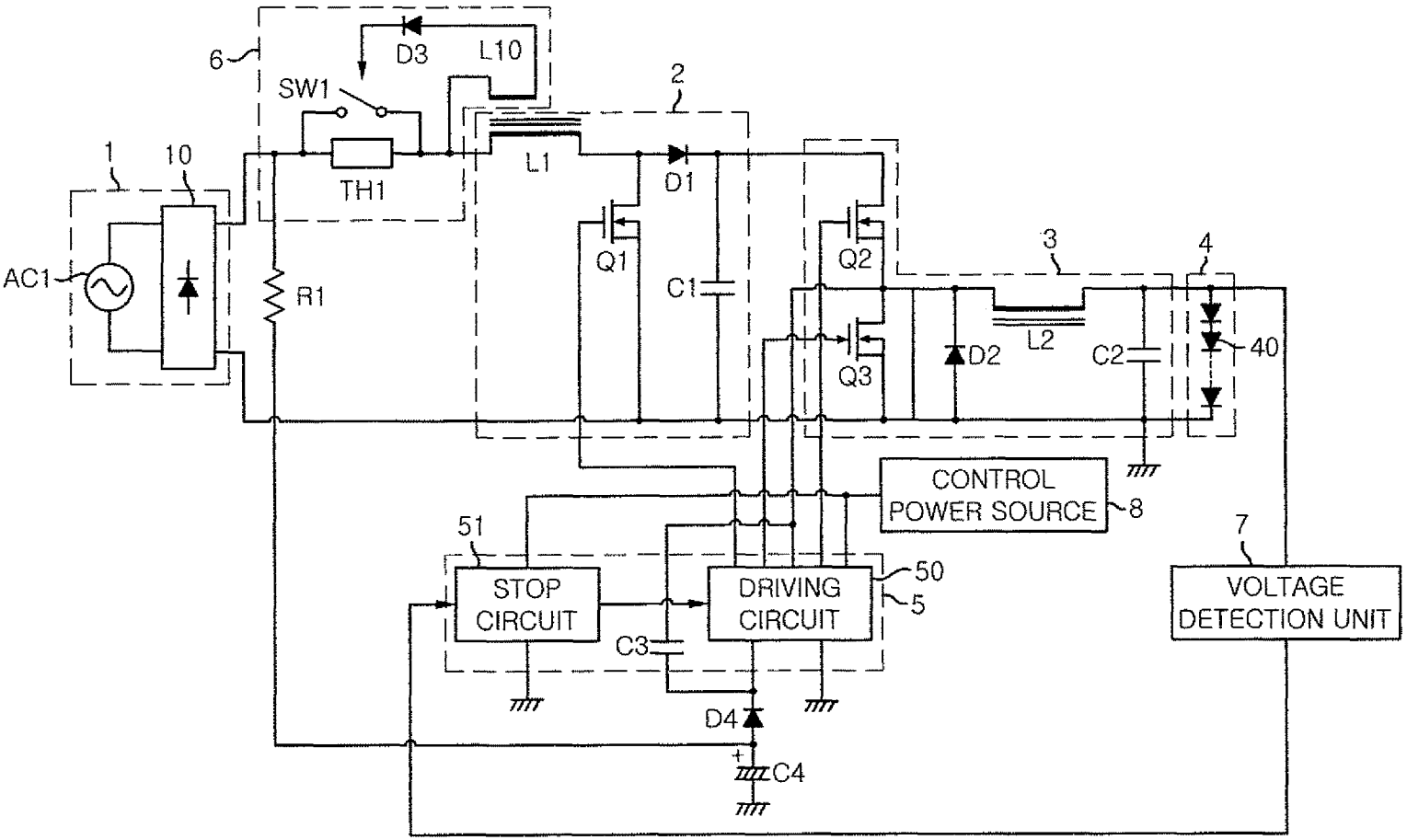
FIG. 2 schematically shows a circuit diagram of a second embodiment of an LED lighting device in accordance with the present invention.

Hereinafter, an LED lighting device in accordance with a second embodiment of the present invention will be described with reference to the FIG. 2. Further, since the basic configuration of the second embodiment is the same as that of the first embodiment, the like reference numerals will be given to like parts and a redundant description thereof will be omitted. The second embodiment is characterized in that, as shown in FIG. 2, a third switching element Q3 is connected in series to the second switching element Q2. Further, the diode D2 is connected in parallel to the third switching element Q3.

Hereinafter, an operation of the second embodiment will be described with reference to FIG. 2. When the second switching element Q2 of the step-down chopper 3 is broken due to an abnormality occurring therein, in the same way as in the first embodiment, the detection voltage detected by the voltage detection unit 7 exceeds a predetermined threshold value. Consequently, the stop circuit 51 of the controller 5 applies a stop signal to the driving circuit 50 such that the driving circuit 50 stops the operation of each of the switching elements Q1 and Q2. In this case, the driving circuit 50 applies a drive signal to the third switching element Q3 at the same time such that the third switching element Q3 is switched on. Consequently, the current outputted from the DC power supply unit 1 is divided to flow through a path passing through the light source unit 4 and a path passing through the third switching element Q3. Accordingly, in this embodiment, it is possible to primarily protect the light source unit 4 by dividing the load current flowing toward the light source unit 4.

Further, in the present embodiment, when the DC power supply unit 1 is turned on, the driving circuit 50 of the controller 5 applies a drive signal to the third switching element Q3 such that the third switching element Q3 is switched on. Accordingly, the driving capacitor C3 is charged before the switching operation of the second switching element Q2 is started. The driving capacitor C3 is charged by the current flowing in a loop including a series circuit of the charging capacitor C4, the diode D4, the driving capacitor C3, and the third switching element Q3. Since the driving capacitor C3 can be charged through a charging path not passing through the second inductor L2, it is possible to reduce the time required until a voltage across the driving capacitor C3 is stabilized as compared to a case where the second inductor L2 is included in the charging path.

Further, in the present embodiment, it is preferable that a parasitic capacitance of the third switching element Q3 is smaller than that of the second switching element Q2. By allowing the third switching element Q3 to have a smaller parasitic capacitance, it is possible to decrease the amount of charges accumulated in the parasitic capacitance during the switching operation, and reduce switching loss. Alternatively, a series circuit including the third switching element Q3 and a resistor connected in series to each other may be connected between a source of the second switching element Q2 and the ground.

Figure 3:
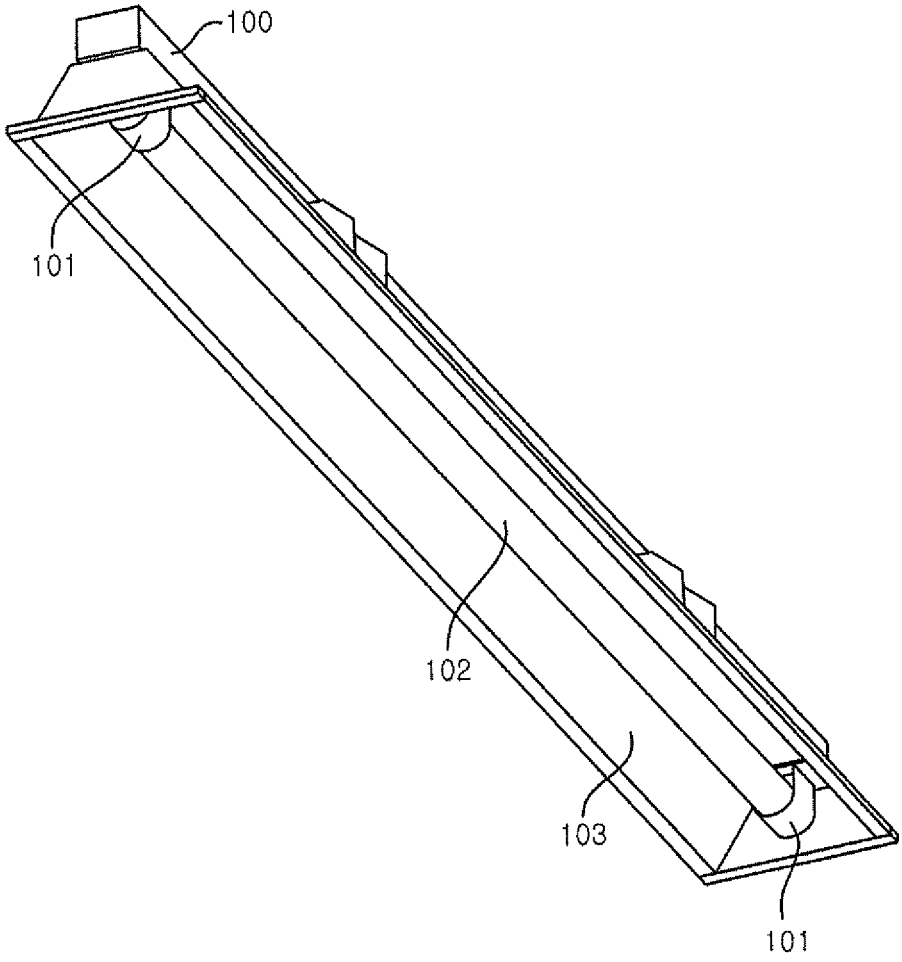
FIG. 3 schematically shows an embodiment of an illumination apparatus in accordance with the present invention.

Hereinafter, an illumination apparatus in accordance with an embodiment of the present invention will be described with reference to the drawing. The illumination apparatus of the present embodiment includes, as shown in FIG. 3, an apparatus main body 100 formed of a long box body having the LED lighting device (not shown) of the first or second embodiment. Sockets 101 are mechanically supported at both end portions of the apparatus main body 100 in a longitudinal direction such that a tubular LED lamp 102 having the light source unit 4 is detachably installed to the sockets 101. Further, a reflector 103 is attached to the apparatus main body 100 to reflect light from the LED lamp 102 to illuminate a target space. The reflector 103 is formed of, e.g., aluminum, and formed in a long box shape having an open bottom surface and an opening area which increases toward the bottom. An inner surface of the reflector 103 is coated with a reflecting material (not shown). Accordingly, a reflecting surface is formed such that the light from the LED lamp 102 is reflected downward.

The present embodiment may have the same effect as that of the first or second embodiment by using the LED lighting device of the first or second embodiment. A configuration of the illumination apparatus is not limited to the configuration of the present embodiment, and the illumination apparatus may have various configurations as long as the LED lighting device and the apparatus main body having the LED lighting device and the light source unit 4 are included therein.

While the invention has been shown and described with respect to the embodiments, it will be understood by those skilled in the art that various changes and modification may be made without departing from the scope of the invention as defined in the following claims.

What is claimed is:

1. An LED lighting device comprising:

a step-up chopper which includes at least a first inductor and a first switching element, the step-up chopper serving to increase an output voltage applied from an external DC power supply and output the increased output voltage;

a step-down chopper which includes at least a second inductor and a second switching element, the step-down chopper serving to decrease the output voltage from the step-up chopper and apply the decreased output voltage to a light source unit having one or more light emitting diodes;

a controller which controls operations of the first switching element and the second switching element;

a current limiter which includes a current limiting element for limiting current flowing therethrough and a switch for switching between a path passing through the current limiting element and a path not passing through the current limiting element on a front side of the step-up chopper; and a voltage detection unit which detects a load voltage applied to the light source unit, wherein the controller stops an operation of the first switching element when the voltage detection unit detects the voltage applied to the light source unit exceeding a predetermined voltage value, and the switch allows a current to flow through the path passing through the current limiting element when the operation of the first switching element is stopped.

2. The LED lighting device of claim 1, wherein, in the current limiter, a current flows through the path passing through the current limiting element at the time when the DC power supply is turned on, and the switch allows the current to flow through the path not passing through the current limiting element when an operation of the step-up chopper is started.

3. The LED lighting device of claim 1, wherein the step-down chopper further includes a third switching element connected in series to the second switching element, and the controller converts a state of the third switching element into an ON state when the voltage detected by the voltage detection unit exceeds the predetermined voltage value.

4. The LED lighting device of claim 2, wherein the step-down chopper further includes a third switching element connected in series to the second switching element, and the controller converts a state of the third switching element into an ON state when the voltage detected by the voltage detection unit exceeds the predetermined voltage value.

5. An illumination apparatus comprising: the LED lighting device of claim 1, and an apparatus main body having the LED lighting device and the light source unit.

6. An illumination apparatus comprising: the LED lighting device of claim 2, and an apparatus main body having the LED lighting device and the light source unit.

7. An illumination apparatus comprising: the LED lighting device of claim 3, and an apparatus main body having the LED lighting device and the light source unit.

8. An illumination apparatus comprising: the LED lighting device of claim 4, and an apparatus main body having the LED lighting device and the light source unit.

* * * * *